US007634931B2

(12) United States Patent
Segien et al.

(10) Patent No.: US 7,634,931 B2
(45) Date of Patent: Dec. 22, 2009

(54) REKEYABLE LOCK CYLINDER ASSEMBLY WITH ADJUSTABLE PIN LENGTHS

(75) Inventors: Donald J. Segien, Trabucco Canyon, CA (US); Richard J. Veltman, Towson, MD (US)

(73) Assignee: Newfrey LLC, Newark, DE (US)

( * ) Notice: Subject to any disclaimer, the term of this patent is extended or adjusted under 35 U.S.C. 154(b) by 0 days.

(21) Appl. No.: 11/070,636

(22) Filed: Mar. 2, 2005

(65) Prior Publication Data

US 2005/0172687 A1 Aug. 11, 2005

Related U.S. Application Data

(63) Continuation-in-part of application No. 10/379,143, filed on Mar. 4, 2003, now abandoned.

(51) Int. Cl.
*E05B 25/00* (2006.01)

(52) U.S. Cl. ..... 70/384; 70/492; 70/493; 70/495; 70/496; 70/378; 70/368

(58) Field of Classification Search ..... 70/382–384, 70/492, 493, 495, 496, 376, 378, 367–371
See application file for complete search history.

(56) References Cited

U.S. PATENT DOCUMENTS

| | | | |
|---|---|---|---|
| 1,565,556 | A | 12/1925 | Fremon |
| 1,610,224 | A | 12/1926 | Dalboni et al. |
| 1,965,889 | A | 7/1934 | Gerald |
| 2,139,842 | A | 12/1938 | Miller |
| 2,194,469 | A | 3/1940 | Fremon |
| 2,232,017 | A | 2/1941 | Wilder |
| 2,370,862 | A | 3/1945 | Johnstone |
| 2,391,832 | A | 12/1945 | Johnstone |
| 2,895,323 | A | 7/1959 | Ernest |
| 2,977,785 | A | 4/1961 | Kendrick et at. |
| 3,149,486 | A | 9/1964 | Russell |
| 3,183,692 | A | 5/1965 | Check |
| 3,190,093 | A | 6/1965 | Schlage |
| 3,320,781 | A | 5/1967 | Hill |
| 3,589,153 | A | 6/1971 | Hill |
| 3,667,262 | A | 6/1972 | Hill |
| 3,726,116 | A | 4/1973 | Dimotta |
| 3,728,880 | A | 4/1973 | Falk |
| 3,735,612 | A | 5/1973 | Popovici |
| 3,754,422 | A | 8/1973 | Stackhouse |
| 3,910,083 | A | 10/1975 | Burlingame |
| 3,990,282 | A | 11/1976 | Sorum |
| 3,999,413 | A | 12/1976 | Raymond et al. |

(Continued)

FOREIGN PATENT DOCUMENTS

| | | |
|---|---|---|
| EP | 0 157 967 | 10/1985 |

(Continued)

*Primary Examiner*—Suzanne D Barrett
(74) *Attorney, Agent, or Firm*—Richard J. Veltman; John D. DelPonti

(57) ABSTRACT

A rekeyable lock cylinder includes a plug body and a backing rack that cooperate to define a plurality of pin chambers within the lock cylinder, with each of the pin chambers housing a corresponding pin. Movement of the backing rack changes the configuration of the pin chambers, thereby allowing the corresponding pins to change configuration to match the bitting on a valid key.

23 Claims, 6 Drawing Sheets

U.S. PATENT DOCUMENTS

| | | | | |
|---|---|---|---|---|
| 4,015,458 | A | 4/1977 | Mercurio | |
| 4,069,694 | A | 1/1978 | Raymond et al. | |
| 4,094,175 | A | 6/1978 | Pechner | |
| 4,142,391 | A | 3/1979 | Paig | |
| 4,320,639 | A | 3/1982 | Kleefeldt et al. | |
| 4,372,139 | A | 2/1983 | Laake | |
| 4,376,382 | A | 3/1983 | Raymond et al. | |
| 4,377,940 | A | 3/1983 | Hucknall | |
| 4,393,673 | A | 7/1983 | Widen | |
| 4,404,824 | A | 9/1983 | Hennessy | |
| 4,412,437 | A | 11/1983 | Smith | |
| 4,440,009 | A | 4/1984 | Smith | |
| 4,689,978 | A | 9/1987 | Drummond | |
| 4,712,399 | A | 12/1987 | Mattossovich | |
| 4,712,401 | A | 12/1987 | Monahan | |
| 4,712,402 | A | 12/1987 | Monahan | |
| 4,729,231 | A | 3/1988 | Wu | |
| 4,732,023 | A | 3/1988 | Shen | |
| 4,741,188 | A | 5/1988 | Smith | |
| 4,747,281 | A | 5/1988 | Monahan | |
| 4,765,163 | A | 8/1988 | Trull et al. | |
| 4,794,772 | A | 1/1989 | Falk et al. | |
| 4,836,002 | A | 6/1989 | Monahan | |
| 4,850,210 | A | 7/1989 | Adler et al. | |
| 4,899,563 | A | 2/1990 | Martin | |
| 4,909,053 | A | 3/1990 | Zipf, III et al. | |
| 4,912,953 | A | 4/1990 | Wobig | |
| 4,920,774 | A | 5/1990 | Martin | |
| 4,942,749 | A | 7/1990 | Rabinow | |
| 4,966,021 | A | 10/1990 | Boag | |
| 4,996,856 | A | 3/1991 | Lin et al. | |
| 5,010,753 | A | 4/1991 | Boris, Jr. | |
| 5,024,071 | A | 6/1991 | Shafirkin | |
| 5,038,589 | A | 8/1991 | Martin | |
| 5,044,180 | A | 9/1991 | Lebrecht | |
| 5,076,081 | A | 12/1991 | Boris, Jr. | |
| 5,121,619 | A | 6/1992 | Martin | |
| 5,174,136 | A | 12/1992 | Thwing | |
| 5,209,088 | A | 5/1993 | Vaks | |
| 5,211,044 | A | 5/1993 | Kim | |
| 5,233,850 | A | 8/1993 | Schroeder | |
| 5,325,690 | A | 7/1994 | Adler et al. | |
| 5,431,034 | A | 7/1995 | Fann et al. | |
| 5,540,071 | A | 7/1996 | Reikher | |
| 5,640,865 | A | 6/1997 | Widen | |
| 5,718,136 | A | 2/1998 | Aldieri et al. | |
| 5,752,400 | A | 5/1998 | Kim | |
| 5,765,417 | A | 6/1998 | Bolton | |
| 5,791,181 | A | 8/1998 | Sperber et al. | |
| 5,884,512 | A | 3/1999 | Wayne | |
| 5,921,122 | A | 7/1999 | Lin | |
| 5,921,123 | A | 7/1999 | Schwarzkopf et al. | |
| 5,970,760 | A | 10/1999 | Shen | |
| 6,047,577 | A | 4/2000 | Klimas | |
| 6,076,386 | A | 6/2000 | Etchells et al. | |
| 6,079,240 | A | 6/2000 | Shvarts | |
| 6,119,495 | A | 9/2000 | Loreti | |
| 6,134,928 | A | 10/2000 | Kang | |
| 6,142,717 | A | 11/2000 | Staiger | |
| 6,295,850 | B1 | 10/2001 | Anderson | |
| 6,425,274 | B1 | 7/2002 | Laitala et al. | |
| 6,516,643 | B1 | 2/2003 | Olshausen | |
| 6,532,782 | B2 | 3/2003 | Chiu | |
| 6,564,601 | B2 | 5/2003 | Hyatt Jr. | |
| 6,776,017 | B2 | 8/2004 | Herdman | |
| 6,860,131 | B2 * | 3/2005 | Armstrong et al. | 70/492 |
| 6,862,909 | B2 * | 3/2005 | Armstrong et al. | 70/492 |
| 6,871,520 | B2 * | 3/2005 | Armstrong et al. | 70/492 |
| 2003/0037582 | A1 | 2/2003 | Edwards, Jr. et al. | |
| 2003/0084692 | A1 | 5/2003 | Herdman | |
| 2003/0089149 | A1 | 5/2003 | Suzuki et al. | |
| 2003/0154753 | A1 | 8/2003 | Dimig et al. | |
| 2004/0069030 | A1 | 4/2004 | Takadama | |
| 2005/0011242 | A1 * | 1/2005 | Armstrong et al. | 70/493 |
| 2005/0016234 | A1 * | 1/2005 | Strader et al. | 70/492 |
| 2005/0039506 | A1 * | 2/2005 | Armstrong et al. | 70/492 |
| 2005/0039507 | A1 * | 2/2005 | Armstrong et al. | 70/492 |
| 2005/0103073 | A1 * | 5/2005 | Armstrong et al. | 70/493 |
| 2005/0120765 | A1 * | 6/2005 | Erdely | 70/492 |
| 2005/0155399 | A1 * | 7/2005 | Armstrong et al. | 70/493 |

FOREIGN PATENT DOCUMENTS

| | | |
|---|---|---|
| EP | 0 210 037 | 1/1987 |
| EP | 0 872 615 | 10/1998 |
| WO | WO 93/14290 | 7/1993 |
| WO | WO 97/36072 | 10/1997 |

* cited by examiner

REKEYABLE LOCK CYLINDER ASSEMBLY WITH ADJUSTABLE PIN LENGTHS

The present application is a continuation-in-part application of application Ser. No. 10/379,143, filed Mar. 4, 2003 now abandoned.

a. The present invention relates generally to lock cylinders and particularly to lock cylinders that can be rekeyed. More particularly, the invention relates to lock cylinders that can be rekeyed without the use of a master key.

BACKGROUND OF THE INVENTION

When rekeying a cylinder using a traditional cylinder design, the user is required to remove the cylinder plug from the cylinder body and replace the appropriate pins so that a new key can be used to unlock the cylinder. This typically requires the user to remove the cylinder mechanism from the lockset and then disassemble the cylinder to some degree to remove the plug and replace the pins. This requires a working knowledge of the lockset and cylinder mechanism and is usually only performed by locksmiths or trained professionals. Additionally, the process usually employs special tools and requires the user to have access to pinning kits to interchange pins and replace components that can get lost or damaged in the rekeying process. Finally, professionals using appropriate tools can easily pick traditional cylinders.

The present invention overcomes these and other disadvantages of conventional lock cylinders. The lock cylinder of the present invention operates in a transparent way that presents the familiar experience of inserting a key and rotating the key in the lock cylinder, as with current cylinders. However, in the present invention, that same familiar experience is used to rekey the lock cylinder. Thus, the user does not require any special knowledge, training, or tools to rekey the lock cylinder of the present invention.

SUMMARY OF THE INVENTION

The present invention is a rekeyable cylinder that includes a plurality of generally cylindrical split pins. Each split pin includes first and second portions that selectively engage each other to vary the length of the pin.

According to one aspect of the invention, each pin portion comprises a half-wall of a cylinder that extends parallel to the longitudinal axis of the pin such that the two portions cooperate to form the cylindrical pin. The base of the cylinder is formed integrally with the first portion and the top wall of the cylinder is formed integrally with the second portion.

According to another aspect of the invention, each half-wall includes a plurality of teeth such that the teeth of the first portion selectively engage the teeth of the second portion to prevent relative movement between the first and second portions and define a pin length.

BRIEF DESCRIPTION OF THE DRAWINGS

The invention and its wide variety of potential embodiments will be readily understood via the following detailed description of certain exemplary embodiments, with reference to the accompanying drawings in which.

DETAILED DESCRIPTION

Certain exemplary embodiments of the present invention provide a rekeyable lock cylinder, comprising: a cylinder body having a longitudinal axis; and a plug assembly and disposed in said cylinder body, said plug assembly comprising a plug body and a backing rack combinable to cooperatively define a plurality of pin chambers, each of said pin chambers housing a corresponding pin comprising a first pin portion releaseably engageable with a second pin portion, said backing rack relatively movable with respect to said plug body parallel to said longitudinal axis to allow disengagement of said first pin portion from said second pin portion.

Certain exemplary embodiments of the present invention provide a method for keying a lock cylinder, comprising the activities of: for a lock cylinder comprising a cylinder body having a longitudinal axis, said lock cylinder further comprising a plug assembly disposed in said cylinder body, said plug assembly comprising a plug body and a backing rack combinable to cooperatively define a plurality of pin chambers, each of said pin chambers housing a corresponding pin comprising a first pin portion releaseably engageable with a second pin portion, said backing rack relatively movable with respect to said plug body parallel to said longitudinal axis to allow disengagement of said plurality of first pin portions from said plurality of second pin portions: while said plurality of first pin portions are not engaged with said plurality of second pin portions, inserting a first key into said plug assembly, said plurality of second pin portions relocated by said first key; and after inserting said first key into said plug assembly, engaging said plurality of first pin portions with said plurality of second pin portions.

Certain exemplary embodiments of the present invention provide a system comprising: a rekeyable lock cylinder coupleable to a door, said rekeyable lock cylinder comprising: a cylinder body having a longitudinal axis; and a plug assembly and disposed in said cylinder body, said plug assembly comprising a plug body and a backing rack combinable to cooperatively define a plurality of pin chambers, each of said pin chambers housing a corresponding pin comprising a first pin portion releaseably engageable with a second pin portion, said backing rack relatively movable with respect to said plug body parallel to said longitudinal axis to allow disengagement of said first pin portion from said second pin portion; and a backing rack releasing tool receiving aperture defined by said rekeyable lock cylinder; and a key adapted to operate said rekeyable lock cylinder.

Figure 1:
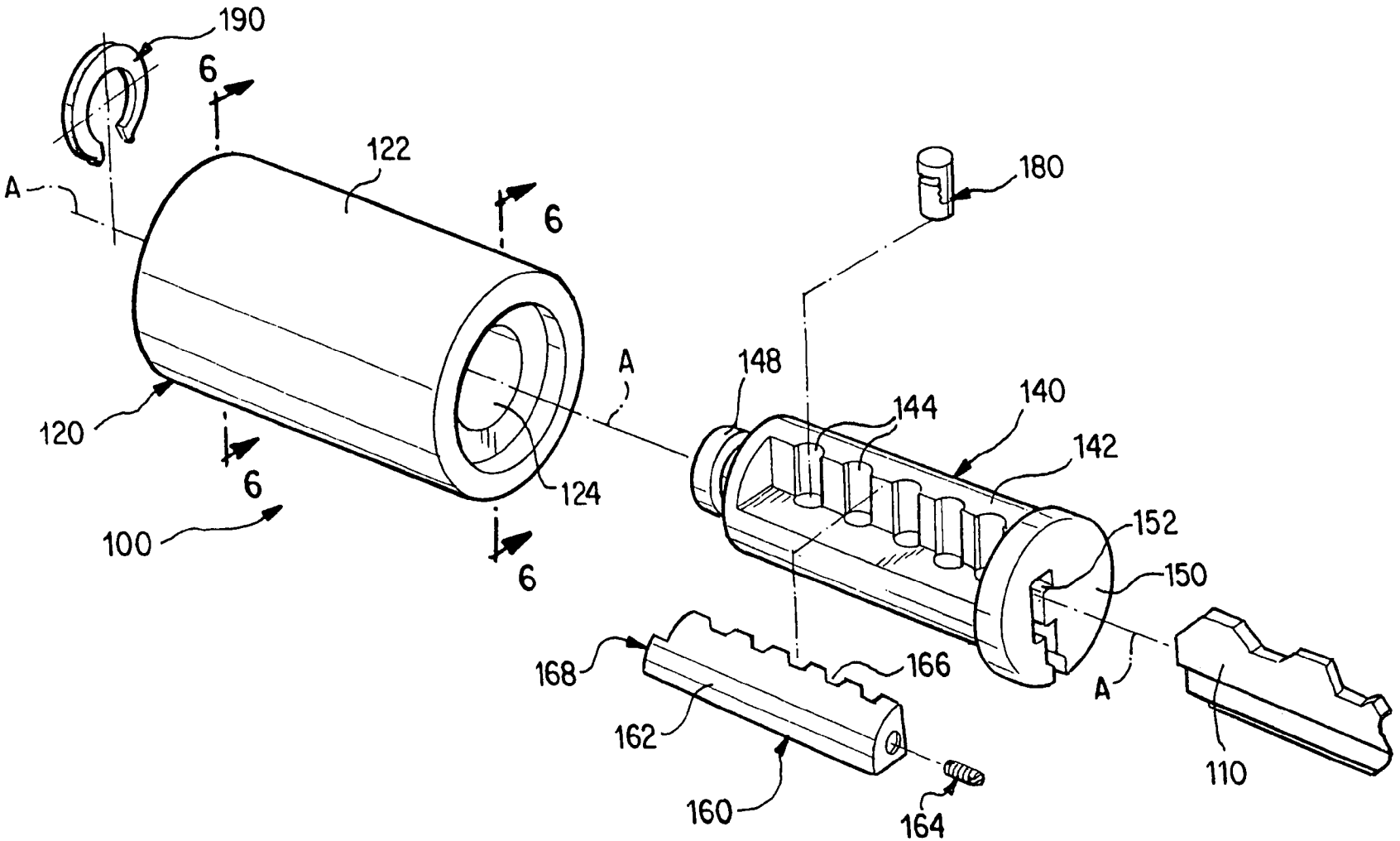
FIG. 1 is a front perspective assembly view of an exemplary embodiment of a system of the present invention.

FIG. 1 is a front perspective assembly view of an exemplary embodiment of a system 100 of the present invention. System 100 can comprise a valid key 110, a lock cylinder assembly 120 defining a longitudinal axis A-A, a plug assembly 140, and a plug clip 190 that can resist relative longitudinal movement between cylinder assembly 120 and plug assembly 140. Cylinder assembly 120 can comprise a cylinder body 122, a cylinder inner surface 124, and a longitudinally spaced, radially-aligned plurality of cylinder pin chambers (not shown) each at least partially containing a corresponding cylinder pin and spring (not shown). Plug assembly 140 can comprise a plug body 142 that at least partially defines a plurality of longitudinally spaced, radially aligned pin chambers 144, a plug clip retainer 148, a plug face 150, a keyway 152, and a plurality of adjustable length pin assemblies 180. Plug assembly 140 also can comprise a backing rack assembly 160 that can comprise a backing rack 162, a backing rack spring 164, a pin retainer 166, and a ramp contact surface 168. Plug assembly 140 can engage a latch mechanism (not shown) attached to a door (not shown).

As shown, plug body 142 can resemble an elongated shape having a longitudinal cross section resembling approximately three-quarters of a circle. Backing rack 162 can resemble an elongated shape having a longitudinal cross section resembling approximately one-quarter of a circle. Note that as long as plug body 142 and backing rack 162 cooperate to form approximately a completely circular longitudinal cross section, there is no particular requirement about what portion of the circle each provides.

Upon insertion of valid key 110 into keyway 152 of plug assembly 140, pin assemblies 180 can relocate to conform to the cut of the key, thereby relocating cylinder pins (not shown) located in cylinder 122 such that a shear line (not shown) can be established, allowing plug assembly 140 to rotate within cylinder assembly 120. System 100 can be installed in a door to lock the door to prevent opening unless a valid key is used to rotate plug assembly 140 from a lock position to an unlock position.

Upon rotation of plug assembly 140 within cylinder 122 to a learn position, the location of backing rack assembly 160 relative to the plug body 142 can change such that pin assemblies 180 can change length. While in the learn position, a new key (not shown) can be inserted.

As plug assembly 140 is rotated away from the learn position, one or more pin assemblies 180 can adjust in length to conform to differences in the cut of the new key versus the old key, and backing rack assembly can at least partially restrain the pin assemblies to the new pin lengths. Thereby, system 100 can learn the new key and be rekeyed to the new key without requiring disassembly, the use of any specialized rekeying tools, and possibly without the use of any rekeying tools whatsoever.

In an alternative embodiment, a moveable stop (not shown) coupled to either cylinder body 122 or plug body 142, can require actuation (such as via pressure applied using a paper clip inserted through an aperture (not shown) in cylinder assembly 120) to allow plug assembly 140 to rotate to the learn position.

Figure 2:
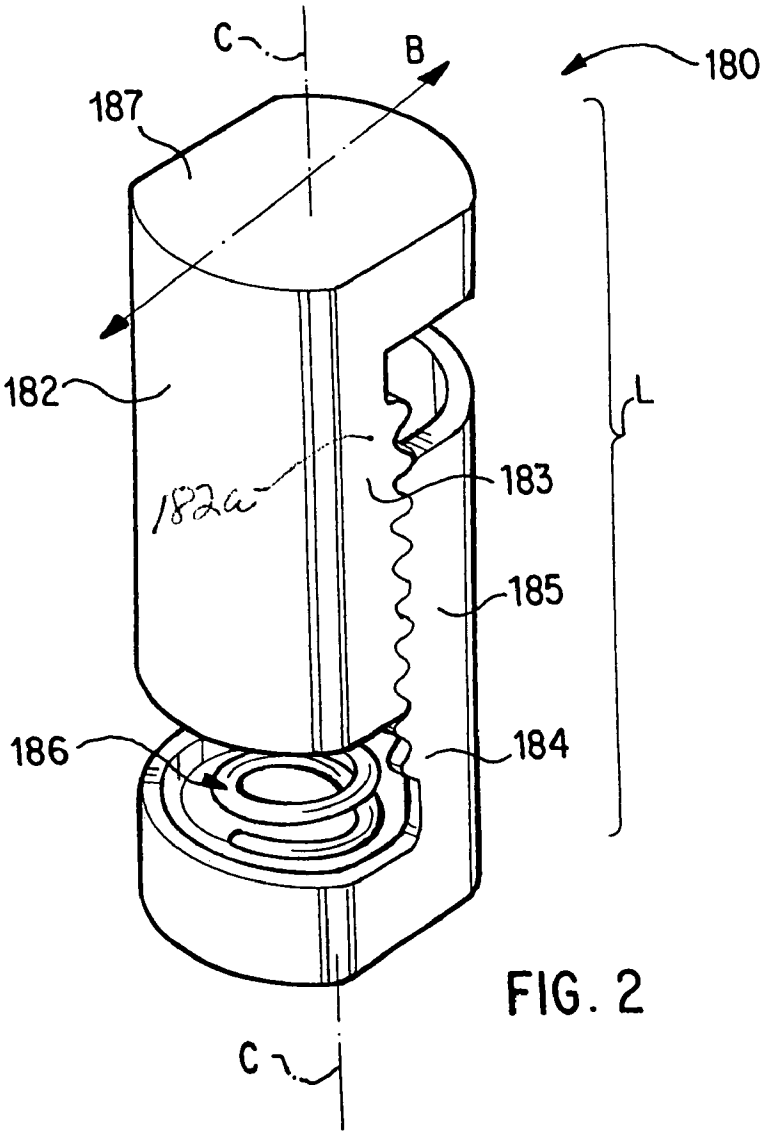
FIG. 2 is a perspective view of an exemplary embodiment of an adjustable length pin assembly of the present invention.

FIG. 2 is a perspective view of an exemplary embodiment of a pin assembly 180 of the present invention. Pin assembly 180 can comprise an upper pin portion 182 and a lower pin portion 184 that can cooperate to form a pin having a longitudinal axis C-C. A pin spring 186 can be disposed to longitudinally increase a length L of pin assembly 180 and/or to separate upper pin portion 182 from lower pin portion 184 along direction B-B and/or along axis C-C. An upper guide surface 183 and/or a lower guide surface 185 can cooperate with an inner wall of pin chamber 144 (shown in FIG. 1) to prevent rotation of pin assembly 180, upper pin portion 182, and/or lower pin portion 184 about axis C-C. A cylinder pin engagement surface 187 can contact and/or cooperate with a cylinder pin (not shown) to form at least a portion of a shear line (not shown) that can allow plug assembly 140 (shown in FIG. 1) to rotate within cylinder assembly 120 (shown in FIG. 1).

Figure 3:
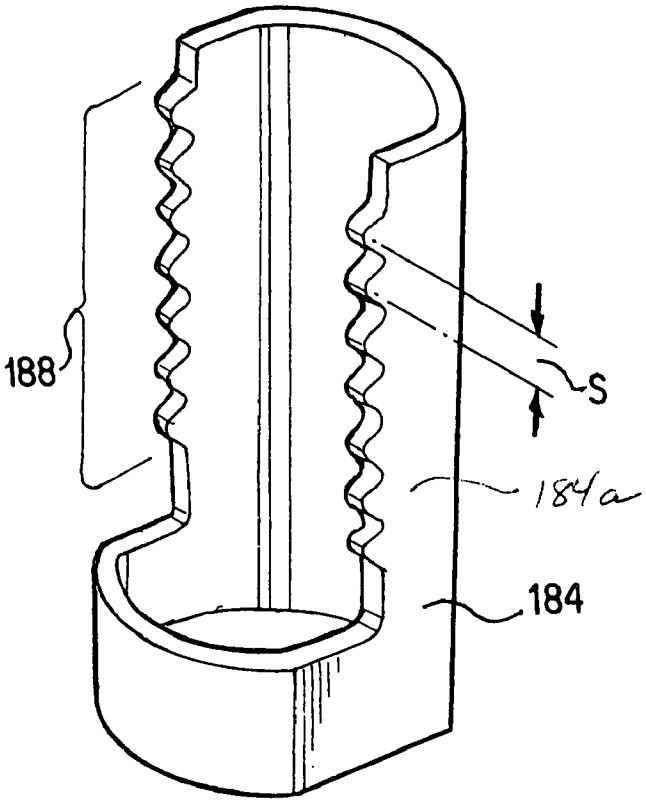
FIG. 3 is a perspective view of an exemplary embodiment of an adjustable length pin portion of the present invention.

FIG. 3 is a perspective view of an exemplary embodiment of an exemplary pin portion of the present invention, such as upper pin portion 182 or lower pin portion 184. The pin portion can comprise at least one row, and possibly two rows (as shown), containing a plurality of teeth 188, which can be spaced a distance S from peak-to-peak and/or from valley-to-valley. Spacing S can be equivalent to a key cut depth increment. A contour of each tooth 188 can be predetermined to optimize operation of pin assembly 180 (shown in FIG. 2).

Figure 4:
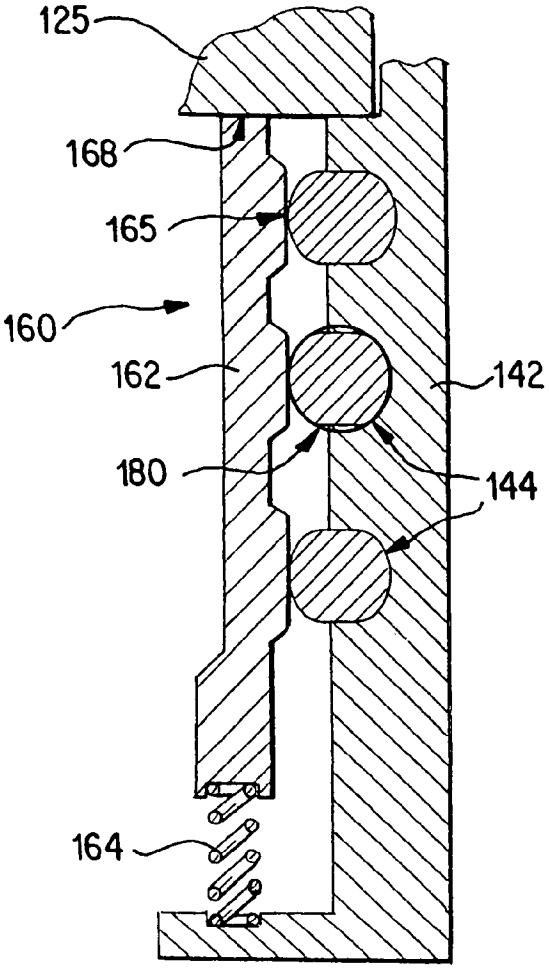
FIG. 4 is a top view of an exemplary embodiment of a system of the present invention in a normal mode.

FIG. 4 is a top view of an exemplary embodiment of a system 100 of the present invention in a normal mode, which can correspond to either a lock position or an unlock position. As shown, plug body 142 defines a plurality of pin chambers 144 that are shaped to cooperate with pin guide surfaces 183, 185 (shown in FIG. 2) to restrain movement of pin assemblies 180 to certain directions with respect to plug body 142. Backing rack assembly 160, which can comprise backing rack 162, backing rack spring 164, pin restrainers 165, and ramp contact surface 168, can, in cooperation with cylinder cap 125, further restrain movement of pin assemblies 180 with respect to plug body 142. Thus, referring to FIGS. 2 and 4, when system 100 is in a normal mode, pin restrainers 165 can resist relative movement of upper pin portion 182 with respect to lower pin portion 184 along direction B-B, thereby preventing a change in length L of pin assembly 180, and orienting pin assembly 180 perpendicular to an axis of the plug assembly. Thus, upper pin portion 182 and lower pin portion 184 can emulate a solid pin of a given length, having an axis C-C or parallel thereto.

Figure 5:
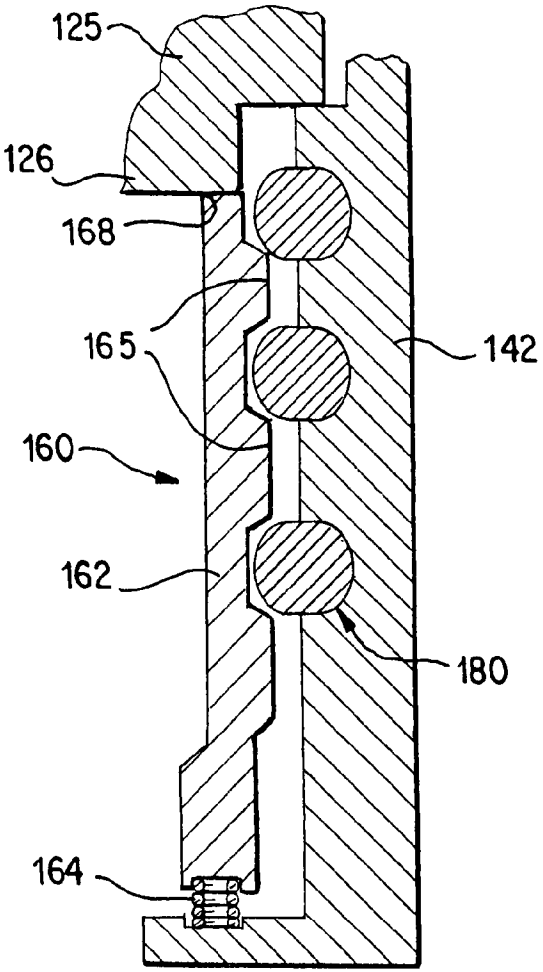
FIG. 5 is a top view of an exemplary embodiment of a system of the present invention in a learn mode.

FIG. 5 is a top view of an exemplary embodiment of a system 100 of the present invention in a learn mode, which can correspond to the learn position described previously. Backing ramp 126, which can be coupled to cylinder cap 125, can engage with ramp contact surface 168 of backing rack 162 function as a backing rack relocator that relocates backing rack 162 and compresses backing rack spring 164. In an unshown alternative embodiment, backing ramp 126 can be recessed into cylinder cap 125, such that backing rack 162 moves toward cylinder cap 125 as system 100 enters the learn mode. In another unshown alternative embodiment, backing rack 162 can remain stationary and plug body 142 can move axially (i.e., along, and/or parallel to, a longitudinal axis of cylinder body 122, in either direction (i.e., either inward or outward) with respect to backing rack 162, as system 100 enters the learn mode. In yet another unshown alternative embodiment, both backing rack 162 and plug body 142 can move axially, yet move relative to each other axially as well. Regardless of how the relative movement is generated between backing rack 162 and plug body 142 along and/or parallel to the longitudinal axis of cylinder body 122, referring to FIGS. 2 and 5, pin restrainers 165 of backing rack assembly 160 can be disposed to allow relative movement of upper pin portion 182 with respect to lower pin portion 184 along direction B-B, thus allowing a change in length L of pin assembly 180.

Considering further this relative pin portion movement, and referring to FIGS. 1 and 2, as pin spring 186 biases upper pin portion 182 apart from lower pin portion 184, upper pin portion 182 is constrained in its motion along axis C-C by cylinder inner surface 124, and lower pin portion 184 is constrained in its motion along axis C-C by the key. At this point, the key may be removed. As the key is removed, upper pin portion 182 can remain at least partially constrained in its motion along axis C-C by cylinder inner surface 124, and lower pin portion 184 cam be somewhat free, thereby allowing relative movement between and/or separation of upper pin portion 182 and lower pin portion 184. This relative movement can cause at least a partial disengagement of the teeth of upper pin portion 182 from the teeth of lower pin portion 184.

Figure 7:
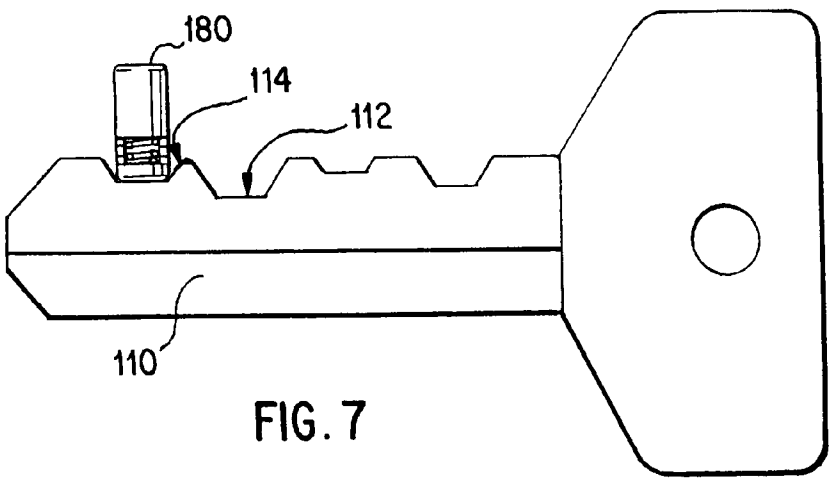
FIG. 7 is a side view of an exemplary embodiment of a key and an adjustable length pin assembly of the present invention.

As the key is removed, each lower pin portion 184 can ride up and down the ramps of the key (see FIG. 7). Once the key is completely removed, each lower pin portion 184 can be constrained by features (not shown) within the plug body.

Referring to FIGS. 1, 2, and 7, as a new key 110 is inserted into keyway 152, at least one lower pin portion 184 can ride up and down the ramps of the new key. When the new key is fully inserted, each pin assembly 180 can be compressed to the correct length for the new key to operate plug assembly 140 within cylinder assembly 120 (i.e., the lockset).

Referring to FIGS. 1-5, as the new key is turned to rotate the plug assembly in reverse and away from the learn position, ramp contact surface 168 rides down the backing rack ramp 126 causing the pin retainer 166 to relocate into a pin restraining position. At this point, the teeth of each pin assembly 180 are engaged and/or meshed, and the length of each pin assembly 180 is fixed. As the plug continues to turn away from the learn position, any movable stop (not shown) that was actuated can return to its neutral position, thereby resisting a rotation of plug assembly 140 toward the learn position.

Figure 6:
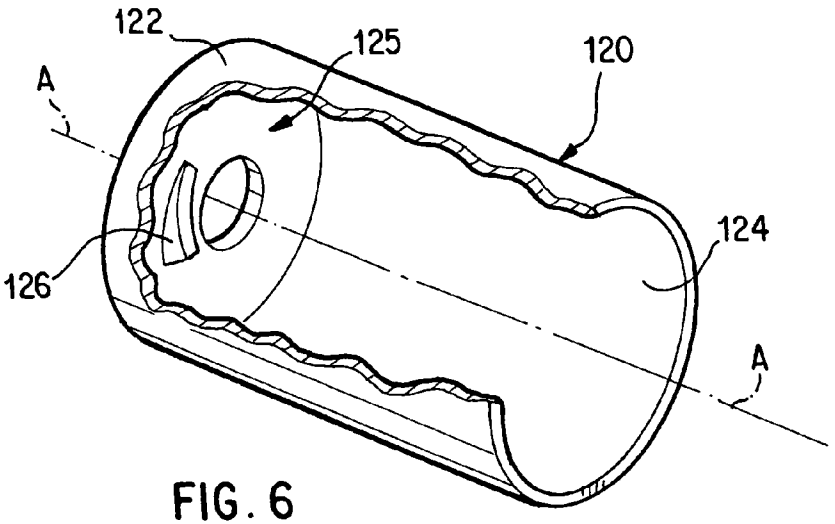
FIG. 6 is a perspective view of an exemplary embodiment of a cylinder assembly of the present invention.

FIG. 6 is a perspective view of an exemplary embodiment of a cylinder assembly 120 of the present invention. Cylinder assembly 120 can comprise a cylinder body 120, a cylinder inner surface 124 that can contain plug assembly 140 (shown in FIG. 1). Coupled to cylinder cap 125 can be a backing rack ramp 126 that can serve to relocate backing rack assembly 160 and/or backing rack 162 (shown in FIGS. 1, 4, 5).

FIG. 7 is a side view of an exemplary embodiment of a key 110 and pin assembly 180 of the present invention. Adjustable length pin assembly 180 can cooperate with flats 112 of key 110, which can be separated by key ramps 114.

Figure 8:
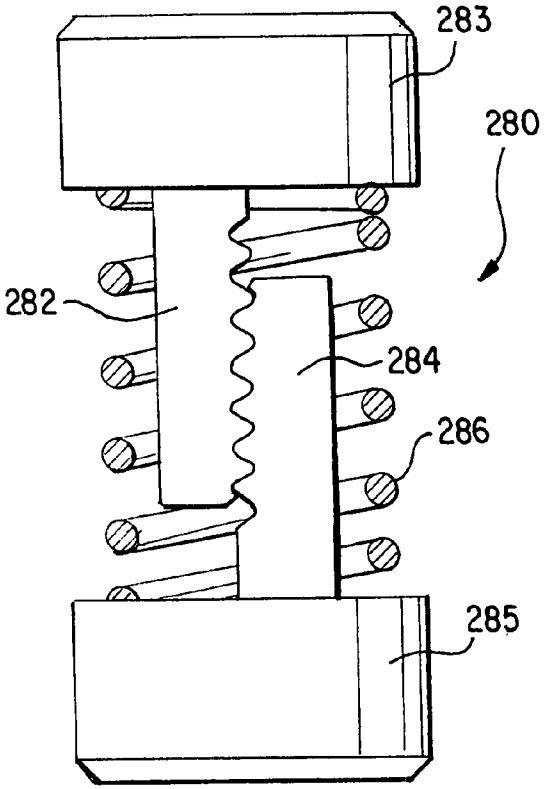
FIG. 8 is a side view of an exemplary embodiment of an adjustable length pin assembly of the present invention.

FIG. 8 is a side view of an exemplary embodiment of an alternative pin assembly of the present invention. Alternative adjustable length pin assembly 280 can include an upper pin portion 282, an upper pin cap 283, a lower pin portion 284, and a lower pin cap 285. Alternative pin assembly 280 can also include a pin spring 286 disposed around upper pin portion 282 and lower pin portion 284, and bearing against upper pin cap 283 and lower pin cap 285.

Figure 9:
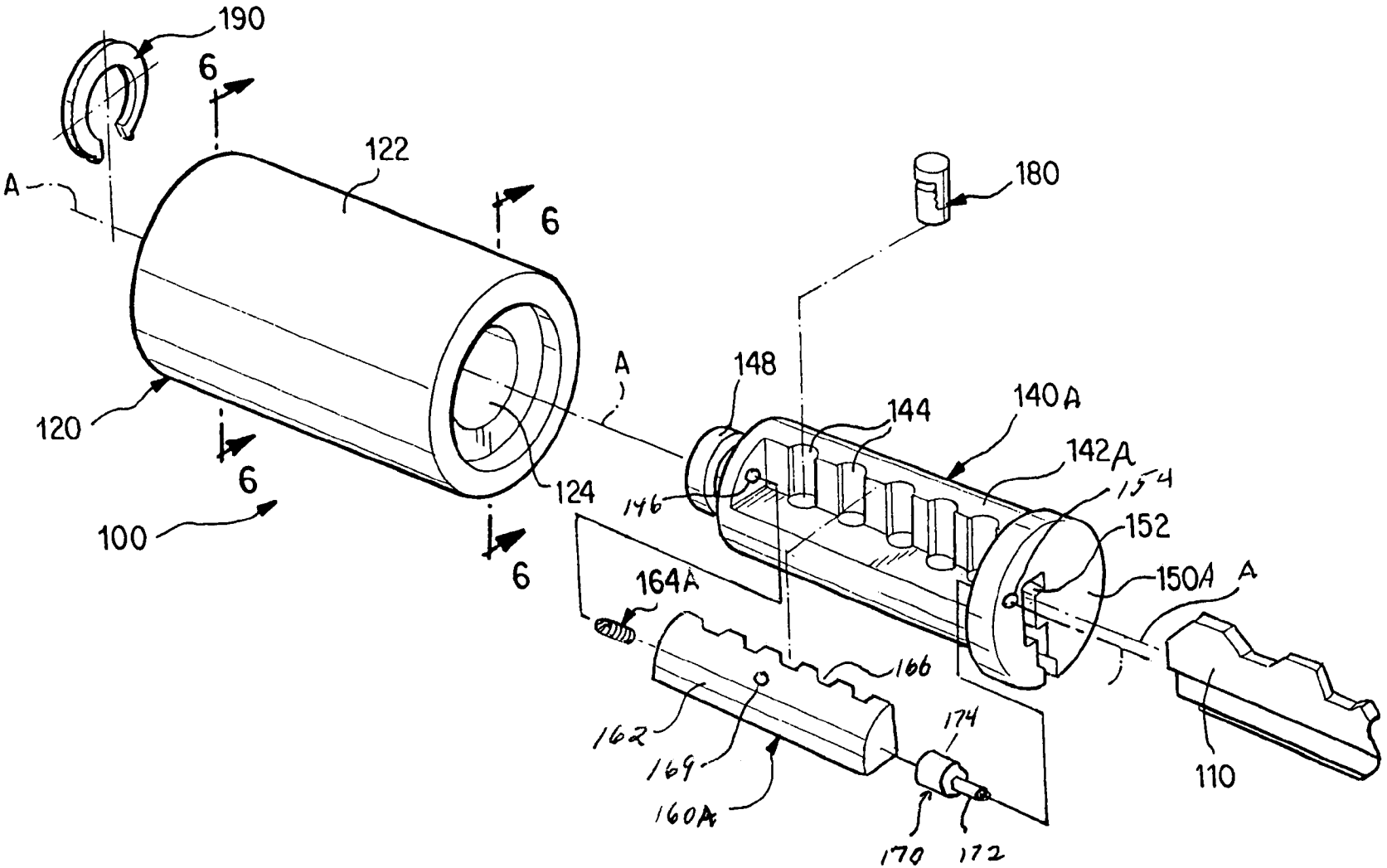
FIG. 9 is a front perspective assembly view of a second exemplary embodiment of a system of the present invention.

FIG. 9 is a front perspective assembly view of a second exemplary embodiment of a system of the present invention. System 100A includes a valid key 110, a lock cylinder assembly 120 defining a longitudinal axis A-A, a plug assembly 140A, and a plug clip 190 that can resist relative longitudinal movement between cylinder assembly 120 and plug assembly 140A. Cylinder assembly 120 can comprise a cylinder body 122, a cylinder inner surface 124, and a longitudinally spaced, radially-aligned plurality of cylinder pin chambers (not shown) each at least partially containing a corresponding cylinder pin and spring (not shown).

Plug assembly 140A can comprise a plug body 142A that at least partially defines a plurality of longitudinally spaced, radially aligned pin chambers 144, a plug clip retainer 148, a plug face 150A, a keyway 152, a plurality of adjustable length pin assemblies 180, and a spring-receiving detent 146. Plug assembly 140A also can comprise a backing rack assembly 160A that can comprise a backing rack 162, a backing rack spring 164A, a pin retainer 166, and a push button 170. A rekeying tool, illustratively a push button 170, includes a first portion 172 that extends through an aperture 154 in the plug face 150A and a second portion 174 that is operatively disposed between the back side of the plug face 150A and the backing rack 162. Alternatively, the rekeying tool could be an integral projection formed on the backing rack that extends through the aperture 154 or an external tool, such as a pin or paper clip. A conventional detent ball mechanism 169 can be used to retain the backing rack assembly in the learn position. Alternatively, a spring catch of the type disclosed in U.S. Pat. No. 6,860,131 can be used.

Figure 10:
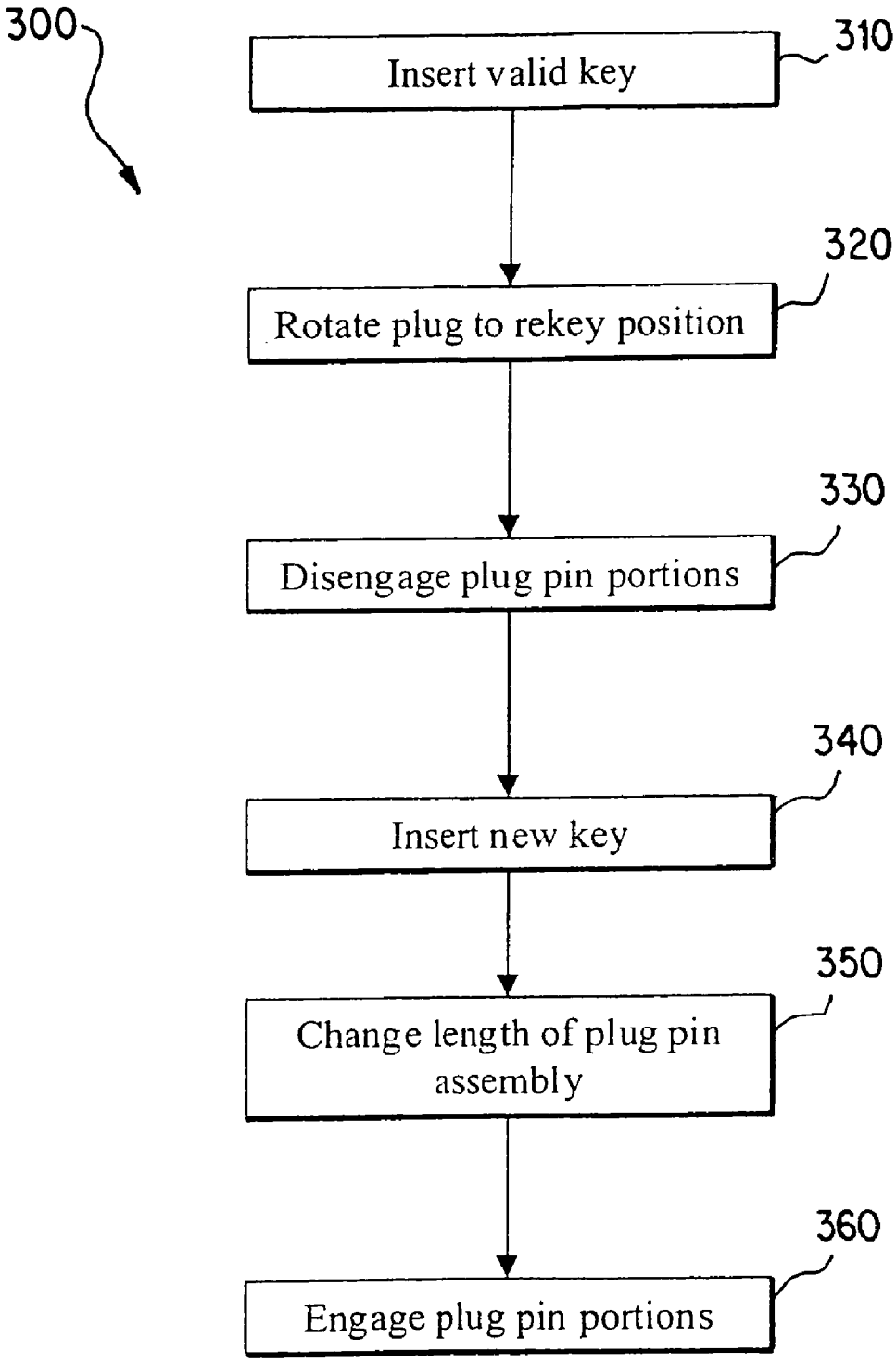
FIG. 10 is a flowchart of an exemplary embodiment of a method of the present invention.

FIG. 10 is a flowchart of an exemplary embodiment of a method 300 of the present invention. At activity 310, a valid key is inserted into the plug assembly, thereby relocating pins and cylinder pins to establish and/or align with a shear line, and thereby allow rotation of the plug assembly within the cylinder assembly.

At activity 320, torsion is applied to the key to rotate the plug assembly within the cylinder body from a locked position to an unlocked position and/or to a rekeying position. The unlocked position can occur at any orientation with respect to the locked position, such as from approximately 10 degrees to approximately 250 degrees, including each number therebetween, such as approximately 30.05, 62, 90, 118.7, 150.03, 180, and/or 224 degrees, etc. The rekeying position can occur at any orientation with respect to the first locked position, such as from approximately 10 degrees to approximately 250 degrees, including each number therebetween, such as approximately 30.05, 62, 90, 118.7, 150.03, 180, and/or 224 degrees, etc.

At activity 330, as the plug assembly is rotated to the rekeying position, the backing rack ramp of the cylinder assembly can contact the ramp contact surface of the backing rack. Referring to FIGS. 4 and 5, this contact can cause the backing rack to move longitudinally, so that the pin retainers lose contact with the pins. Referring to FIG. 2, this loss of contact between the pin retainers and the pins can allow one or more pin springs to bias its respective upper pin portion and lower pin portion apart, along axis C-C and/or in direction B-B. Thus, the teeth of at least one upper pin portion can become disengaged from the corresponding teeth of the lower pin portion sufficiently to allow the pin assembly to lengthen along axis C-C.

In the second embodiment, illustrated in FIG. 9, the backing rack does not automatically move to the learn position when the plug assembly is rotated to the rekeying position. Instead, after the plug assembly is rotated to the rekeying position, the user pushes the first portion 172 of the push button 170 to cause the backing rack to move longitudinally, against the biasing force of the spring 164A, so that the pin retainers lose contact with the pins. Alternatively, a tool, such as a pin or paper clip can be inserted through the aperture 154 in the plug face to push the backing rack longitudinally against the biasing force of the spring 164A.

At activity 340, a new key having a different cut pattern can be inserted into the keyway of the plug assembly, thereby, at activity 350, changing the length of at least one adjustable length pin assembly.

At activity 360, the plug assembly can be rotated in reverse away from the rekeying position (learn mode). By doing so, the ramp contact surface of the backing rack can ride down the backing rack ramp of the cylinder assembly until eventually the ramp contact surface in contact with the cylinder cap. Referring to FIGS. 4 and 5, this loss of contact between the ramp contact surface of the backing rack can cause the backing rack to move longitudinally, so that the pin retainers again make contact with the pins. Referring to FIG. 2, this restoration of contact between the pin retainers and the pins can cause the pin portions to compress the pin spring and/or to move together along axis C-C and/or in direction B-B. Thus, the teeth of at least one upper pin portion can become engaged with the corresponding teeth of the lower pin portion sufficiently to fix and/or resist change of a length of pin assembly as measured along axis C-C, thus learning the pattern of the new key such that the new key is required to operate the plug assembly within the cylinder assembly.

The plug assembly can continue to be rotated until it in either the lock or unlock position. Note that the lock system can be rekeyed without removing the plug clip or removing the plug body from the cylinder body. Note also that because there is no need to remove the plug assembly from the cylinder assembly, no plug follower is required for rekeying. Note also that no specialized tools are necessarily required for rekeying.

Thus, embodiments of the present invention can provide a method for rapidly rekeying a lock cylinder without the need for a plug follower or for removing the plug assembly from the cylinder assembly. Moreover, in certain embodiments of the present invention, the rekeyer is not required to remove a cylinder chimney cover, cylinder pin springs, or cylinder pins.

Although the invention has been described with reference to specific exemplary embodiments thereof, it will be understood that numerous variations, modifications and additional embodiments are possible, and accordingly, all such variations, modifications, and embodiments are to be regarded as being within the spirit and scope of the invention. Also, references specifically identified and discussed herein are incorporated by reference as if fully set forth herein. Accordingly, the drawings and descriptions are to be regarded as illustrative in nature, and not as restrictive.

What is claimed is:

1. A rekeyable lock cylinder, comprising:

a cylinder body having a longitudinal axis;

a plug body disposed in the cylinder body and rotatable about the longitudinal axis; and a backing rack disposed adjacent the plug body and cooperating with the plug body to define a plurality of pin chambers, each pin chamber having a length dimension parallel to the longitudinal axis of the chamber and a width dimension transverse to the length dimension, the width dimension of the plurality of pin chambers changing along the entire length dimension in response to movement of the backing rack; and means disposed in the cylinder body for moving the backing rack parallel to the longitudinal axis.

2. The rekeyable lock cylinder of claim 1, further including a plurality of pins disposed in the plurality of pin chambers, each of the plurality of pins including a length dimension and a width dimension with both dimensions being changeable in response to movement of the backing rack.

3. The rekeyable lock cylinder of claim 2, wherein each of the plurality of pins includes a first pin portion releasably engageable with a second pin portion, the first pin portion disengaging from the second pin portion to change both dimensions.

4. The rekeyable lock cylinder of claim 1, wherein the plurality of pin chambers include a length dimension and a width dimension, the width dimension of the plurality of pin chambers changing in response to movement of the backing rack.

5. The rekeyable lock cylinder of claim 2, wherein each of the plurality of pins further includes resilient means for changing both dimensions.

6. The rekeyable lock cylinder of claim 2, wherein each pin portion of each of the plurality of pins includes at least one side wall extending parallel to the length dimension, the at least one side wall including gear teeth, the gear teeth of the first pin portion being configured to engage and disengage with the gear teeth of the second pin portion, with both dimensions of the plurality of pins changing in response to sequential disengagement and engagement of the gear teeth.

7. A rekeyable lock cylinder according to claim 3, wherein the plug body is rotatable between a first position and a second position, the first pin portion being engaged with the second pin portion in the first position and the first pin portion being disengaged from the second pin portion in the second position.

8. A rekeyable lock cylinder according to claim 2, the plug body being rotatable within the cylinder body about the longitudinal axis between a first position and a second position, both dimensions of the plurality of pins being fixed in the first position and changeable in the second position.

9. A rekeyable lock cylinder according to claim 1, wherein the means for moving includes a push button.

10. A rekeyable lock cylinder comprising:

a cylinder body having a longitudinal axis;

a plug body disposed in the cylinder body and rotatable about the longitudinal axis;

a backing rack disposed adjacent the plug body and cooperating with the plug body to define a plurality of pin chambers, the backing rack being movable parallel to the longitudinal axis, the size of the plurality of pin chambers changing in response to movement of the backing rack; and means for moving the backing rack, wherein the means for moving includes a ramp formed in the cylinder body.

11. A rekeyable lock cylinder according to claim 5, wherein the resilient means for changing includes a plurality of pin springs configured to increase the length dimension of a corresponding pin.

12. A rekeyable lock cylinder according to claim 2, wherein each of the plurality of pins includes a first portion and a second portion, the first and second portions being configured to engage the each other, and further including a plurality of springs surrounding the first pin portion and the second pin portion of a corresponding pin.

13. A method for keying a lock cylinder, comprising the steps of:

providing a lock cylinder having a cylinder body with a longitudinal axis;

providing a plug body disposed in the cylinder body for rotation about the longitudinal axis;

providing a backing rack, the backing rack cooperating with the plug body to define a plurality of pin chambers, each pin chamber having a length dimension and a width dimension;

providing a plurality of pins disposed in the plurality of pin chambers, each pin having a length dimension and a width dimension;

changing the width dimension of the plurality of pin chambers along the entire length dimension of the pin chambers in response to movement of the backing rack; and changing the length dimension and the width dimension of the plurality of pins in response to the change in the width dimension of the plurality of pin chambers.

14. The method of claim 13, further comprising the step of providing means for changing the length dimension and width dimension of the plurality of pins in response to the change in the configuration of the plurality of pin chambers.

15. The method of claim 14, wherein the means for changing includes a plurality of pin springs.

16. The method of claim 15, wherein each of the plurality of pins includes a first portion and a second portion, the first portion being selectively engageable with the second portion, the pin springs being configured to surround the first and second portions.

17. The method of claim 13, further comprising the step of using a rekeying tool to change the configuration of the plurality of pin chambers.

18. The method of claim 17, wherein the plug body includes a plug face and the rekeying tool is disposed in an aperture formed in the plug face.

19. The method of claim 17, wherein the rekeying tool includes a push button.

20. A method for keying a lock cylinder, comprising the steps of:

providing a lock cylinder having a cylinder body with a longitudinal axis;

providing a plug body disposed in the cylinder body for rotation about the longitudinal axis;

providing a backing rack, the backing rack cooperating with the plug body to define a plurality of pin chambers;

providing a plurality of pins disposed in the plurality of pin chambers;

changing the configuration of the plurality of pin chambers in response to movement of the backing rack;

using a rekeying tool to change the configuration of the plurality of pin chambers; and moving said backing rack along a ramp to move the backing rack parallel to the longitudinal axis.

21. The method of claim 20, wherein each of the plurality of pins includes a longitudinal pin axis, a first portion and a second portion, and the step of changing the configuration of the plurality of pins further comprises the step of moving the first pin portion relative and the second pin portion parallel to, and transverse to, the pin axis.

22. The method of claim 20, wherein the step of changing the configuration of the plurality of pins further comprises the step of changing the length of each of the plurality of pins.

23. A method for keying a lock cylinder, comprising the steps of:

providing a lock cylinder having a cylinder body with a longitudinal axis;

providing a plug body disposed in the cylinder body for rotation about the longitudinal axis;

providing a backing rack, the backing rack cooperating with the plug body to define a plurality of pin chambers;

providing a plurality of pins disposed in the plurality of pin chambers;

changing the configuration of the plurality of pin chambers in response to movement of the backing rack;

changing the configuration of the plurality of pins in response to the change in the configuration of the plurality of pin chambers; and using a rekeying tool to change the configuration of the plurality of pin chambers, wherein the rekeying tool includes a ramp formed in the cylinder body.

* * * * *